US010663259B2

(12) United States Patent
Allgaier

(10) Patent No.: US 10,663,259 B2
(45) Date of Patent: May 26, 2020

(54) FIREARM TRAINING APPARATUS AND METHODS

(71) Applicant: ROLERA LLC, Oswego, IL (US)

(72) Inventor: Austin Allgaier, Naperville, IL (US)

(73) Assignee: ROLERA LLC, Oswego, IL (US)

( * ) Notice: Subject to any disclaimer, the term of this patent is extended or adjusted under 35 U.S.C. 154(b) by 284 days.

(21) Appl. No.: 15/650,927

(22) Filed: Jul. 16, 2017

(65) Prior Publication Data

US 2017/0363390 A1 Dec. 21, 2017

Related U.S. Application Data

(63) Continuation of application No. PCT/US2016/013760, filed on Jan. 16, 2016.

(60) Provisional application No. 62/104,328, filed on Jan. 16, 2015.

(51) Int. Cl.
*F41G 3/26* (2006.01)
*F41A 33/02* (2006.01)

(52) U.S. Cl.
CPC ..... *F41G 3/26* (2013.01); *F41A 33/02* (2013.01)

(58) Field of Classification Search
CPC ..... F41A 33/00; F41A 33/02; F41A 33/04; F41A 33/06; F41G 3/26; F41G 3/2655
See application file for complete search history.

(56) References Cited

U.S. PATENT DOCUMENTS

2013/0071815 A1 3/2013 Hudson et al.
2013/0203019 A1 8/2013 Nolen
2014/0272807 A1* 9/2014 Guenther ..... F41G 3/2605 434/19
2015/0253109 A1* 9/2015 Wichner ..... F41A 17/12 434/19

FOREIGN PATENT DOCUMENTS

WO WO 2014145079 A1 9/2014

OTHER PUBLICATIONS

International Search Report and Written Opinion dated Apr. 12, 2016, in connection with International Application No. PCT/US2016/013760, ISRWO-760.
International Preliminary Report on Patentability dated Jul. 18, 2017, in connection with International Application No. PCT/US2016/013760, IPRP-760.

* cited by examiner

*Primary Examiner* — Timothy A Musselman
(74) *Attorney, Agent, or Firm* — Cook Alex, Ltd.; Ryan M. Truesdale

(57) ABSTRACT

A firearm training system includes a firearm, a sensor, a data processor, and a display. The sensor measures and records the motion of the firearm before, during, and after the firearm is shot. In some embodiments, the sensor is located on the firearm. The sensor communicates with the data processor. In some instances this communication is conducted wirelessly. Data regarding the movement of the firearm is analyzed via the data processor and trends are determined. These trends are then correlated with shooting technique deficiencies which can be communicated to a user via the display. In some embodiments, the data processor and display are a single computing device, such as a tablet, smartphone, or laptop.

19 Claims, 19 Drawing Sheets

FIREARM TRAINING APPARATUS AND METHODS

CROSS-REFERENCE TO RELATED APPLICATION(S)

This application is a continuation of and claims priority benefits from International Application No. PCT/US16/13760 filed Jan. 16, 2016 entitled "Firearm Training Apparatus and Methods" which claims priority benefits from U.S. Provisional Patent Application Ser. No. 62/104,328 filed on Jan. 16, 2015, also entitled "Firearm Training Apparatus and Methods". This application is also related to and claims priority benefits from the '328 application. The '328 and '760 applications are hereby incorporated by reference herein in their entireties.

FIELD OF THE INVENTION

The present invention relates to firearm training systems and methods.

BACKGROUND OF THE INVENTION

Use of a firearm to hit a target requires a great deal of skill and practice. Aside from mechanical errors in the firearm itself, hitting the target relies on i) precise aiming of the weapon at the target (known as sighting), and ii) control of the weapon when aiming, firing, and following through. It is important that an individual control the firearm before, during and after the trigger is pulled.

Typically, a firearms instructor provides instruction and feedback to a shooter. The instructor can observe the sighting and control of the weapon during preparation and firing, and can provide the shooter with suitable advice to improve his or her technique.

Conventional training approaches, using stationary diagnostic targets and/or a qualified and experienced instructor, are ineffective at accurately diagnosing shooting technique when other external factors are at play, such as incorrect sighting, overcompensation, inaccurate firearms, etc.

For example, conventional approaches fail to provide an accurate indication of the deviation of a shot from the sighted position. Instructors need to be present to observe the shot, and the shooter has insufficient information to self-diagnose problems with his or her technique.

SUMMARY OF THE INVENTION

A firearm training system includes a firearm and a sensor for measuring and recording the motion of the firearm during a given time period. The time period begins a given amount of time before the user pulls the trigger of the firearm and ends a given amount of time after the trigger has been pulled. In some embodiments, the system also includes a data processor and a display.

The term firearm is meant to include both traditional and simulated firearms.

The sensor can be, among other thing, a laser, a magnetometer, a global positioning system (GPS), an inertial measurement unit (IMU), accelerometers, a gyroscope, or any combination thereof. In some embodiments, the sensor is located on the firearm.

In some embodiments, the data processor communicates with the sensor via a wireless signal such as, but not limited to Bluetooth. The data processor analyzes at least one data point measured by the sensor and in some embodiments, displays the data point on a user interface. In other or the same embodiments, the data processor analyzes a plurality of data points measured by the sensor and determines and displays a trend. In some embodiments, this trend indicates a shooting deficiency.

In some embodiments, the data processor and the display are a single computing device such as, but not limited to, a mobile phone or smartphone, a tablet computer, a notebook computer, a laptop computer, a desktop computer or other suitable electronic computing device.

DEFINITIONS

As used herein the term "firearm" is intended to mean a small arms weapon such as a rifle, pistol or handgun. The user of the system described below is generally the shooter. The term "user" is used to mean the shooter and the user of the firearm training system. In some embodiments, the user could also be an instructor, coach, or training official using the data to provide information to the shooter.

System Overview

The firearm training system can measure and record motion of the firearm, and, more specifically, motion of the firearm after the target has been sighted and when the user of the firearm prepares to fire, pulls the trigger, and follows through. In some embodiments, the motion is tracked in the time period immediately before, during, and immediately after the shot, in which the time period immediately before and the time period immediately after the shot are predetermined values.

The system can analyze the shooting mechanics of the user, and can diagnose deficiencies or errors in technique. The system can score the severity of the deficiencies or errors in technique, provide suggested improvements, and/or track progress over time.

When shooting, the user can be unaware of the reasons for a shot missing the target at which it was aimed. Though in some cases the firearm accuracy can be at fault, in many situations the user is exhibiting one or more deficiencies or errors in shooting technique that can have an impact on the accuracy of the shot.

Without a clear and accurate understanding of his or her underlying fundamental technique, the user can find it difficult to improve his or her accuracy, may compensate for poor technique by adopting other poor techniques (such as adjusting his or her aim), and spend more resources trying to improve. With a clear and accurate understanding of their shooting mechanics, provided for example by the firearm training system, the user can improve accuracy more quickly.

DETAILED DESCRIPTION OF CERTAIN EMBODIMENTS

System Description

Figure 1:
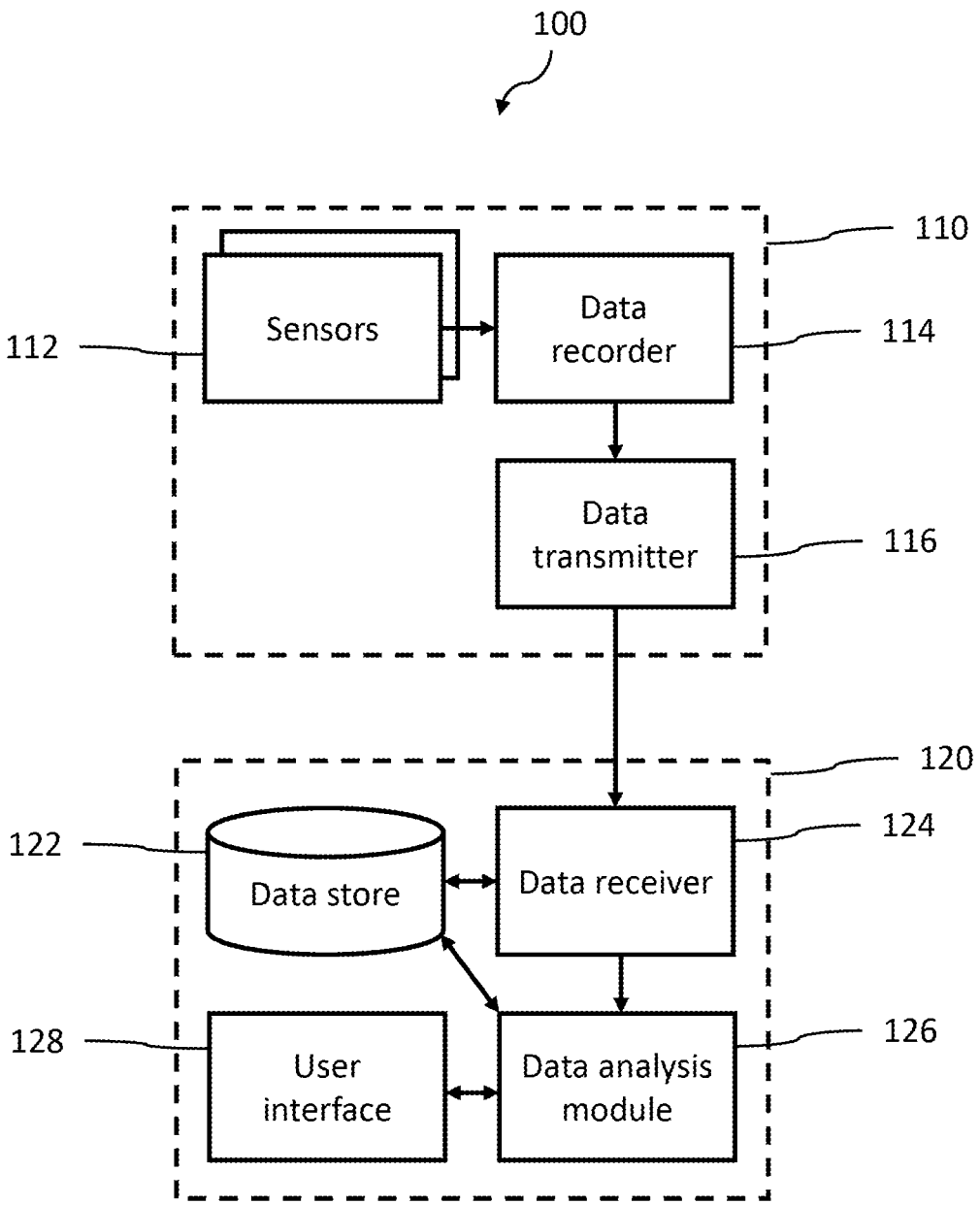
FIG. 1 is a block diagram illustrating an embodiment of a firearm training system.

FIG. 1 is a block diagram illustrating an embodiment of firearm training system 100. Firearm training system 100 comprises sensor subsystem 110 and data processing and display subsystem 120.

In one embodiment, sensor subsystem 110 is located on a firearm, either integral to the firearm or attached to the firearm. For example, sensor subsystem 110 can be attached at a suitable location on the firearm including, but not limited to, the rail, the trigger guard, the magazine, the barrel or the stock.

Sensor subsystem 110 comprises one or more sensors 112, data recorder 114 and data transmitter 116. Sensors 112 can comprise motion-tracking devices including, but not limited to, one or more from the following list: a laser, a magnetometer, a global positioning system (GPS), an inertial measurement unit (IMU), accelerometers and a gyroscope.

Data recorder 114 receives and records sensor data from one or more sensors 112. Data recorder 114 sends sensor data to data transmitter 116 for transmission to data processing and display subsystem 120. Data processing and display subsystem 120 can be located at a distance from the firearm. Transmission of data from sensor subsystem 110 to data processing and display subsystem 120 can be via a wired connection or a wireless communications link.

Data processing and display subsystem 120 comprises data receiver 124, data store 122, data analysis module 126, and user interface 128. Data receiver 124 receives sensor data from data transmitter 116 via the wired connection or wireless communications link, and stores the received sensor data in data store 122.

Sensor data from data receiver 124 and data store 122 can be processed and analyzed by data analysis module 126. Raw data and the results of data analysis can be displayed to a user via user interface 128. Examples of data analysis and displays are provided in the description below.

User interface 128 provides feedback to the user.

Data can be stored locally in sensor subsystem 110 and/or in data processing and display subsystem 120. Data can be collected and aggregated for a series of shots. In some embodiments, aggregate data can be used for determining average scores and/or for establishing a trend.

In one embodiment, firearm training system 100 comprises a hardware device hard-wired to a computer. The hardware device comprises sensor subsystem 110 and the computer comprises data processing and analysis subsystem 120.

In another embodiment, firearm training system 100 comprises a hardware device in wireless communication with a computing device. The hardware device comprises sensor subsystem 110 and the computing device comprises data processing and analysis subsystem 120. The computing device can be a mobile device such as a mobile phone or smartphone, a tablet computer, a notebook computer, a laptop computer, a desktop computer or other suitable electronic computing device.

In another embodiment, firearm training system 100 comprises a mobile application. In yet another embodiment, firearm training system 100 comprises a web site with individual and aggregate data.

Firearm training system 100 can be used with live ammunition rounds, simulator practice (such as airsoft or $CO_2$-powered firearms) or in dry fire practice. System 100 can measure, record and analyze motion data and shooting technique whether the firearm is using live rounds, simulator-type rounds, or is dry firing. System 100 can be used with real firearms or simulated firearms.

The following sections describe aspects of data analysis module 126 and user interface 128.

Heat Map Display

Figure 2A:
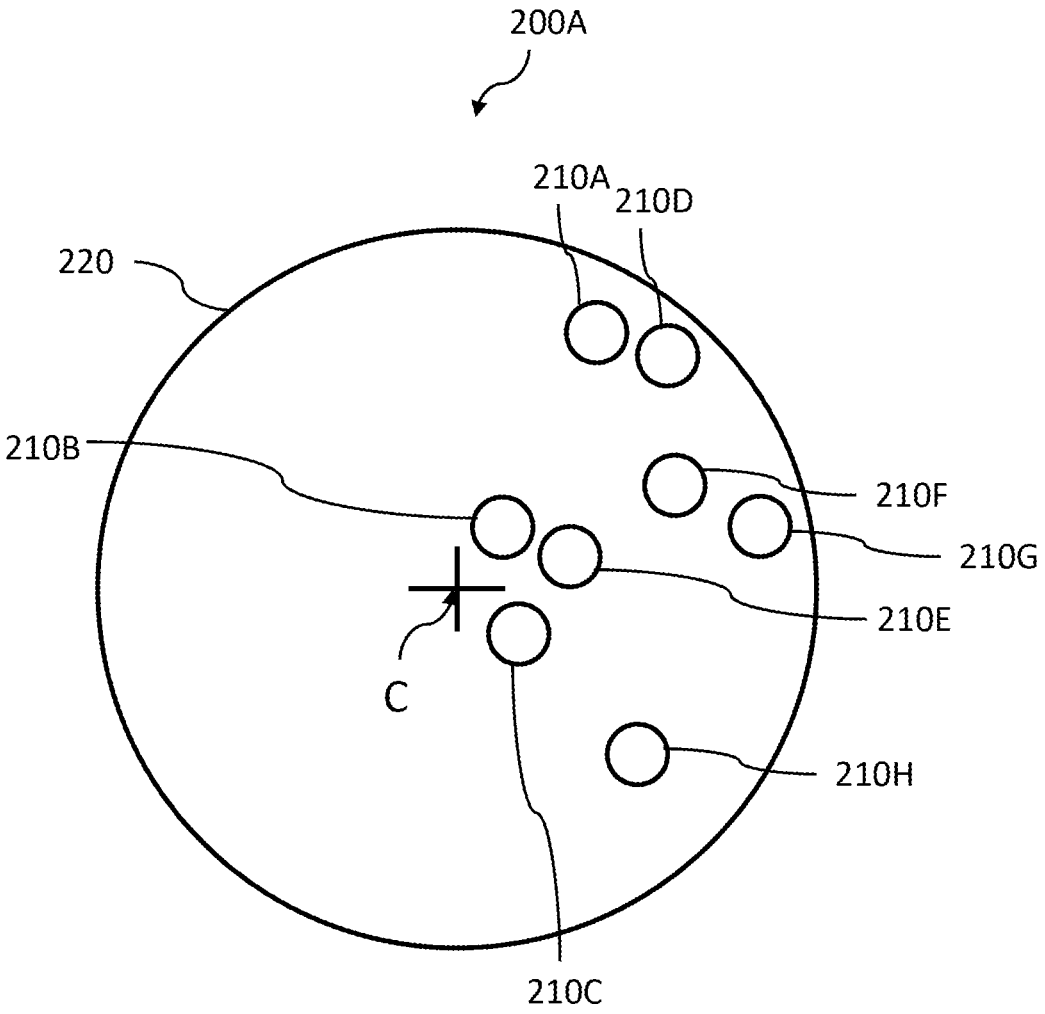
FIG. 2A illustrates an embodiment of a display showing the position of shots relative to a sighted position in a target region.

FIG. 2A illustrates an embodiment of display 200A showing the position of shots 210A through 210H relative to sighted position C in target region 220.

Figure 2B:
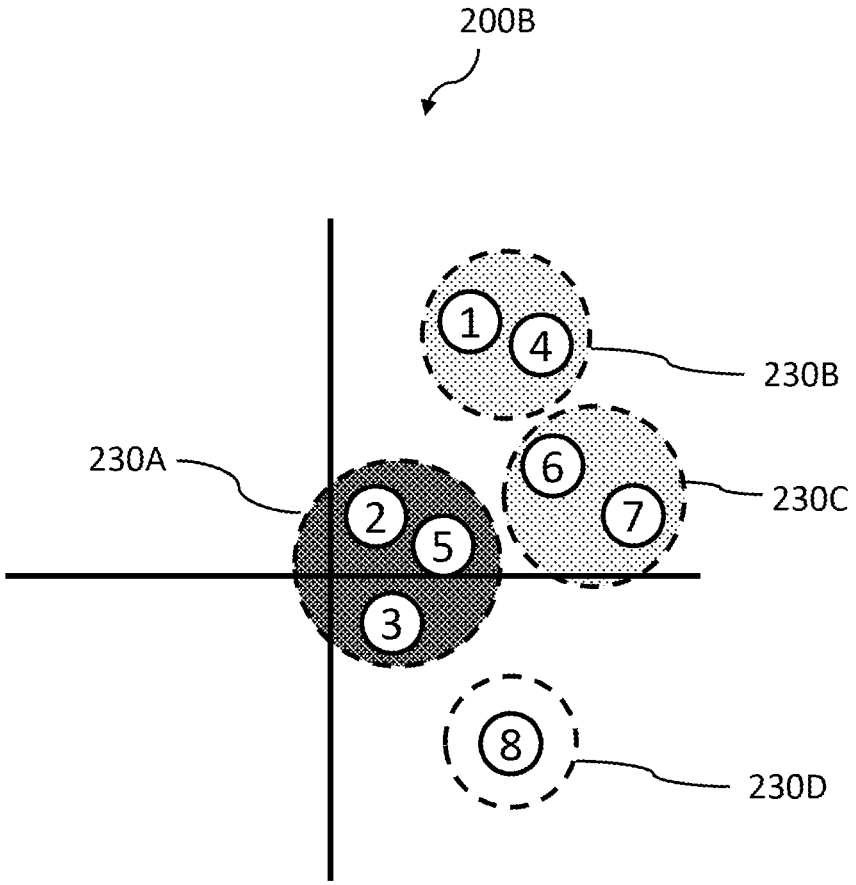
FIG. 2B illustrates an embodiment of a heat map display corresponding to the display of FIG. 2A.

FIG. 2B illustrates an embodiment of heat map display 200B corresponding to display 200A. Shots 210A through 210H of FIG. 2A have been re-labeled in FIG. 2B to indicate the order of arrival of each shot 1 through 9. Heat map display 200B can comprise heat spots 230A through 230D. Heat map display 200B can comprise a visual indication of the density of shots. In some embodiments, the visual indication is provided by shading, patterning or color.

Heat map display 200B can comprise one or more heat contours (not shown in FIG. 2B) indicated by lines, shading, patterning or color.

In FIG. 2B, the hottest area on the display is hot spot 230A which has three closely spaced shots, shot numbered 2, 3 and 5.

Heat map display 200B provides the user (such as the shooter or an instructor) with a visual indication of deviations from the sighted position resulting from deficiencies or errors in shooting technique.

Scoring System

Firearm training system 100 comprises a scoring system for quantifying the shooter's deviation from the sighted position. A benefit of the scoring system is that it provides feedback on the shooter's technique, while eliminating contributions from mechanical shortcomings of the firearm and/or from sighting errors.

Shooting Trend

Firearm training system 100 of FIG. 1 can measure and record the deviation of each shot from its sighted position. As described above, the system can also calculate a score for each shot based on its deviation from the sighted position. The deviation and score of each shot can be displayed on an interface such as user interface 128 of FIG. 1. The interface can be a graphical user interface.

The system can determine a shooting trend, for example whether the shooter's performance is improving with time. Shooting trends can be displayed on the user interface.

Figure 3A:
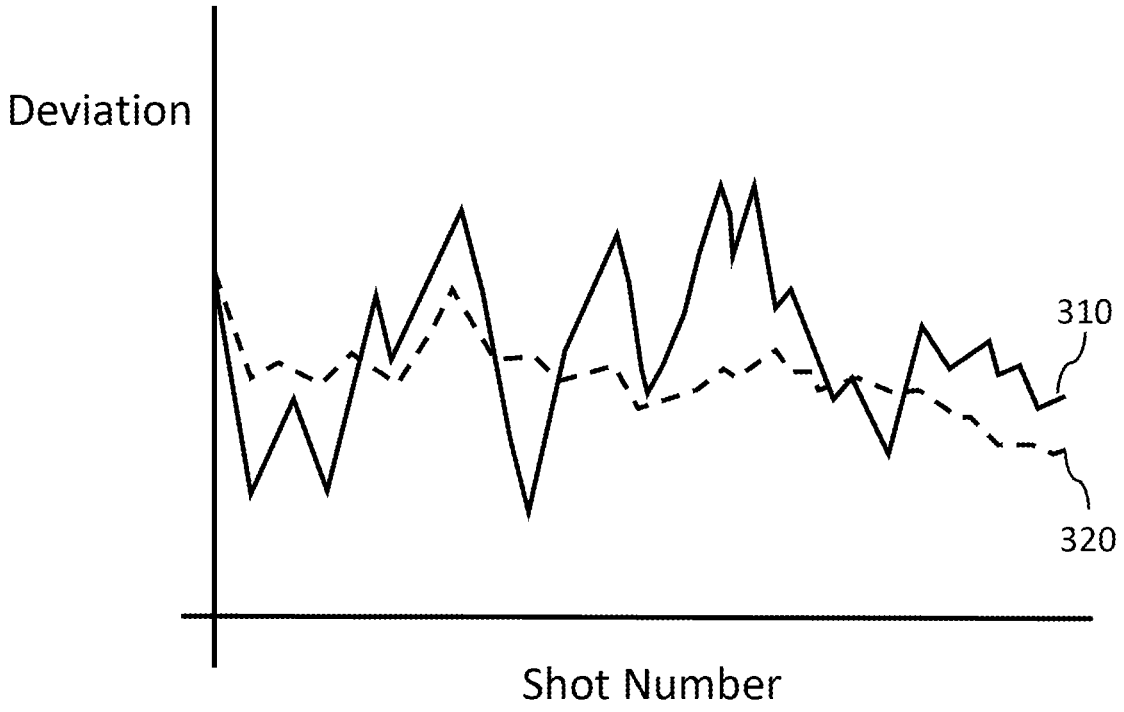
FIG. 3A is a graph illustrating a shooting trend display for a series of consecutive shots showing deviation in distance from the sighted position.

FIG. 3A is a graph illustrating a shooting trend display for a series of consecutive shots showing deviation in distance from the sighted position. Line 310 shows the shot-by-shot deviation from the sighted position. Line 320 shows a rolling average of the deviation from the sighted position. The number of shots used to determine the rolling average can be configured by the user.

Figure 3B:
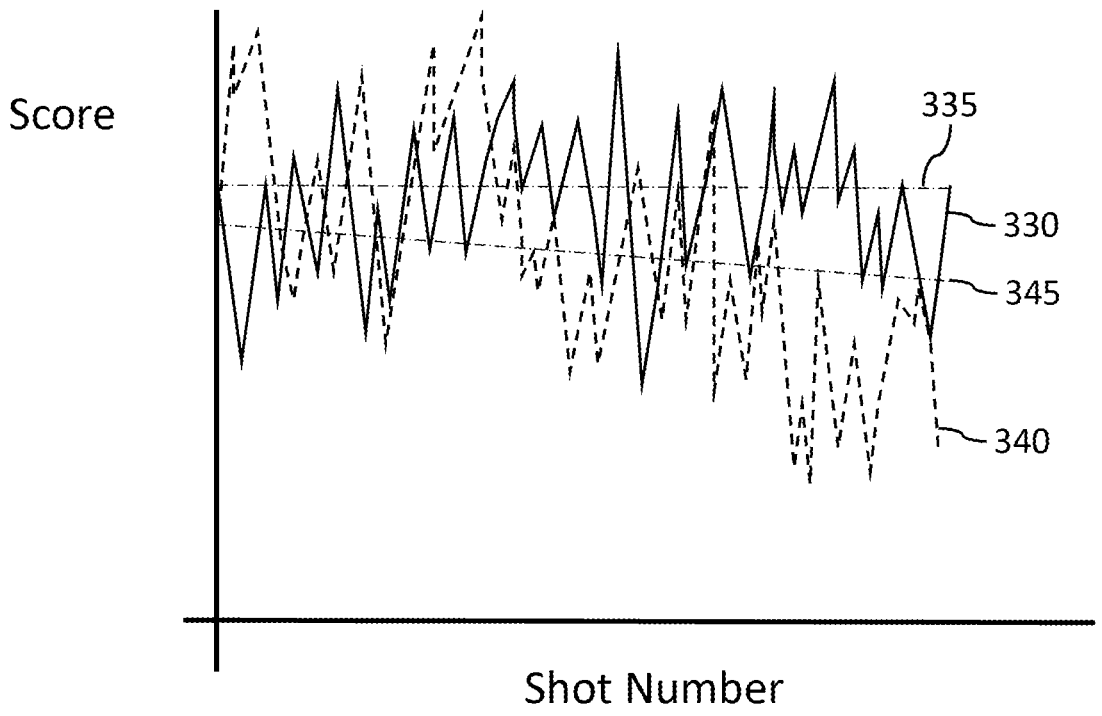
FIG. 3B is a graph illustrating a shooting trend display for a series of consecutive shots showing the score.

FIG. 3B is a graph illustrating a shooting trend display for a series of consecutive shots showing the score. Lines 330 and 335 correspond to a shooter without training or feedback over the duration of the display. Lines 340 and 345 correspond to a shooter receiving training and feedback over the duration of the display.

Lines 330 and 340 show the shot-by-shot score. Lines 335 and 345 show rolling averages of the scores. In the example illustrated in FIG. 3B, the effect of the training is to cause a reduction in the average score, thereby indicating an improvement in the performance of the shooter.

Scoring, Trajectory and Technique Analysis

Figure 4A:
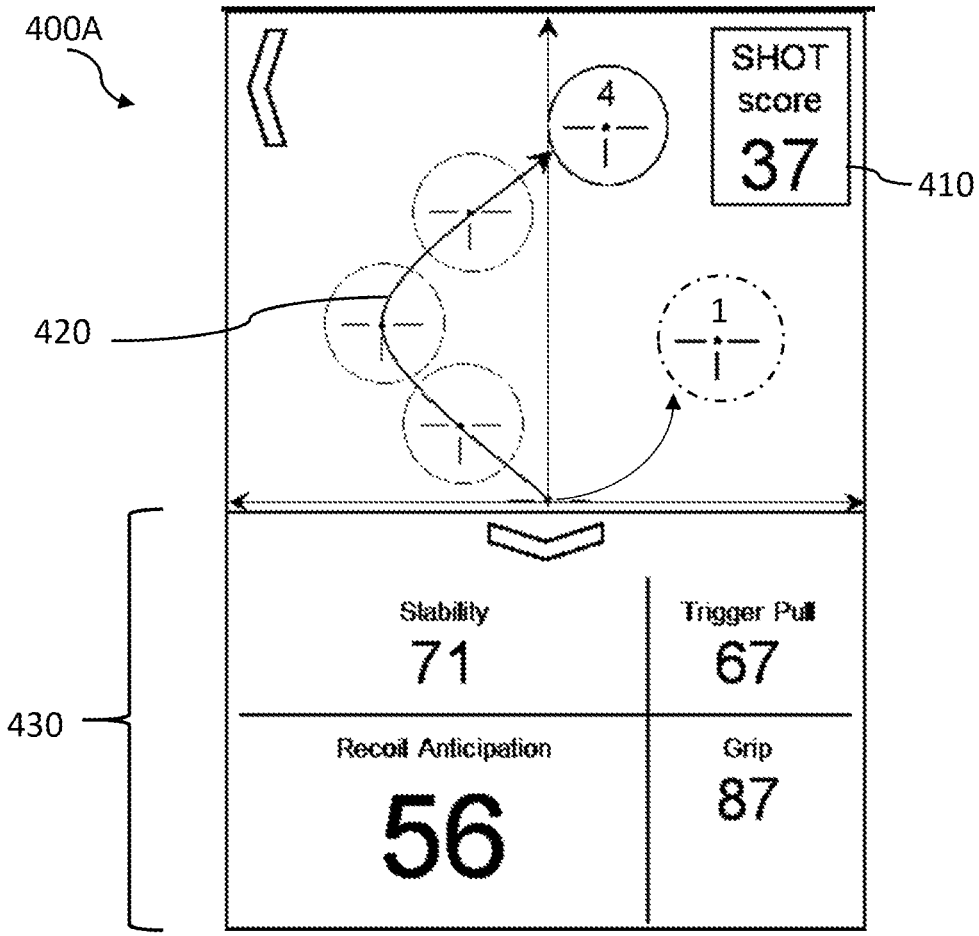
FIGS. 4A, 4B, 5, 6, 7, 8 and 9 are screenshots of displays illustrating an embodiment of a user interface of a firearm training system.
Figure 4B:
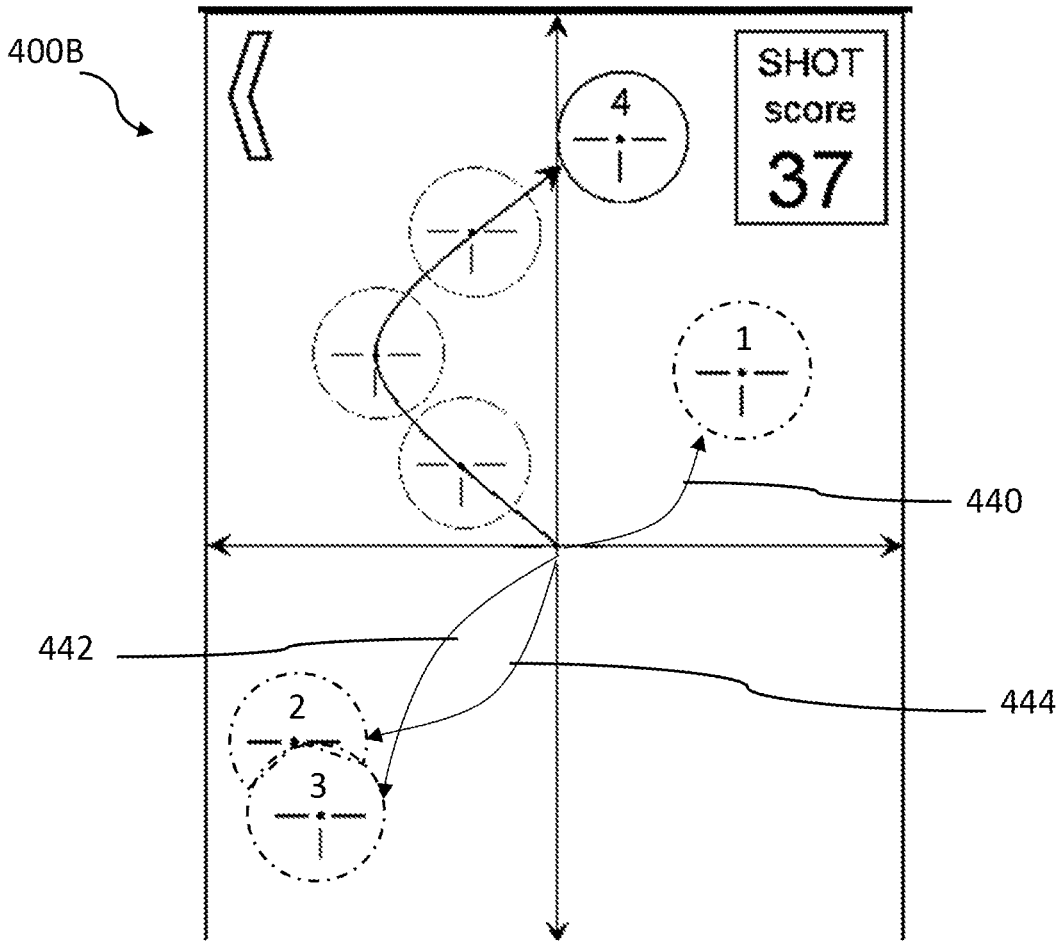

FIGS. 4A and 4B are screenshots of displays 400A and 400B respectively, illustrating an embodiment of a user interface of a firearm training system (such as user interface 128 of firearm training system 100 of FIG. 1). Displays 400A and 400B correspond to a shot fired by the user.

Display 400A of FIG. 4A comprises a box 410 indicating a shot score for the current shot. In this example, the shot is labeled 4 and the shot score is 37 out of 100.

Line 420 shows a trajectory for shot 4, the trajectory providing information to the user and/or the instructor about deficiencies or errors in the shooter's technique.

Display 400A also comprises a region 430 for displaying a set of ancillary scores for aspects of the shooter's technique—based on an analysis of the recorded motion data. In this example, the ancillary scores include stability, trigger pull, recoil anticipation and grip.

Display 400B of FIG. 4B comprises the trajectories for three other shots—shots 1, 2 and 3. The trajectories for shots 1, 2 and 3 can be compared with the trajectory for shot 4.

Figure 5:
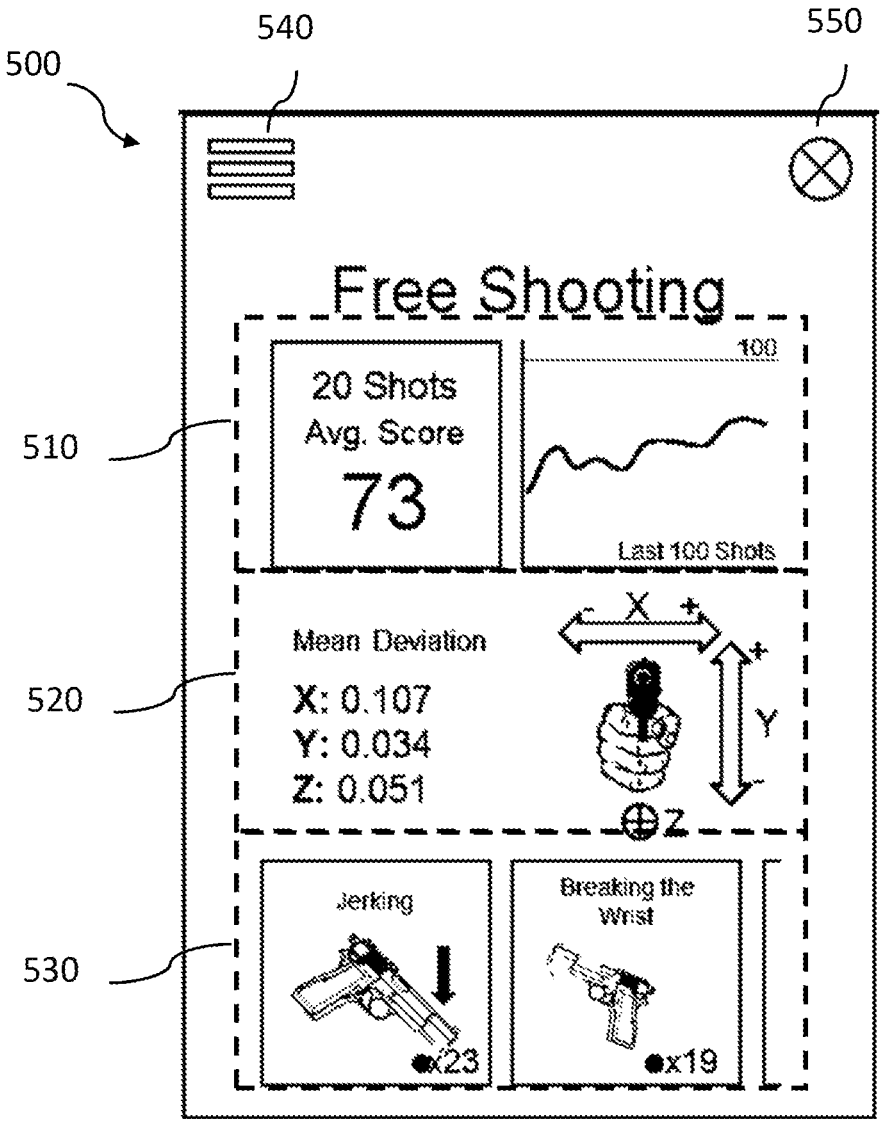

FIG. 5 is a screenshot of display 500 illustrating an embodiment of a user interface of a firearm training system (such as user interface 128 of firearm training system 100 of FIG. 1).

Display 500 comprises display area 510 displaying an average score. In the example shown, the average is a 20-shot average. The number of shots used to determine the average can be configurable.

In the example shown, display area 510 further comprises a plot of the score for the last 100 shots. The plot can provide a measure of the variability in shooting performance, and can be indicative of a trend.

Display 500 further comprises display area 520 displaying a mean x, y, z deviation from the sighted position. An interpretation of the x, y, z coordinates is provided in display area 520. The x-coordinate can be regarded as a left-right deviation from the sighted position, and the y-coordinate can be regarded as an up-down deviation from the sighted position. The z-coordinate can represent a deviation towards or away from the sighted position.

The firearm training system described herein can analyze the x, y, z deviation and provide feedback related to shooting technique. Display 500 comprises display area 530 displaying feedback to the user. For example, feedback can comprise an indication of one or more deficiencies or errors in shooting technique, the indication, in some instances, accompanied by an illustration and/or a count of the number of times the deficiency or error has occurred.

Display 500 also comprises menu 540 and exit button 550. In some embodiments, menu 540 can be a drop-down menu and can contain a range of options including, but not limited to, navigation options, save options, preferences and settings. The user can select exit button 550 to exit display 500 and return to a previous or higher-level display.

Figure 6:
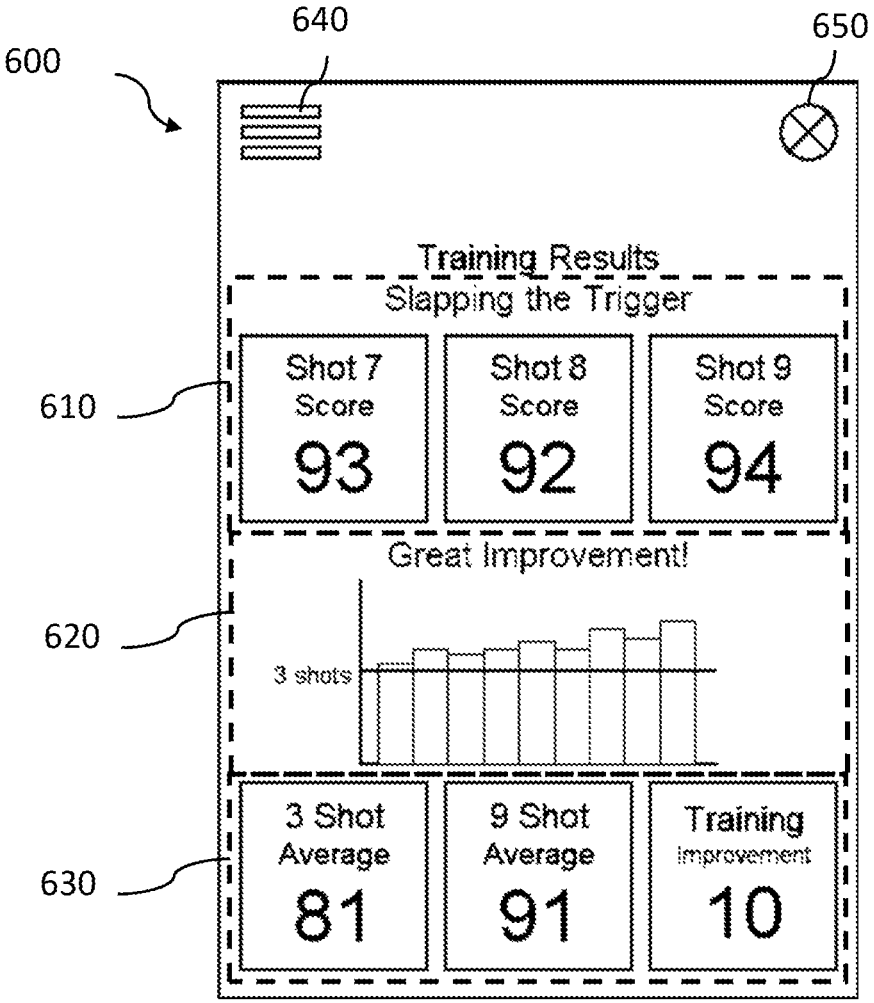

FIG. 6 is a screenshot of display 600 illustrating an embodiment of a user interface of a firearm training system (such as user interface 128 of firearm training system 100 of FIG. 1).

Display 600 is related to training results. Display 600 comprises display area 610 displaying individual shot scores during a training session. In the example shown, the training exercise is related to "Slapping the Trigger". Display 600 further comprises display area 620 providing a visual indication of shooting performance derived from the training results relative to a benchmark performance. Display area 620 can also provide a written commentary on shooting performance such as an indication of the improvement in performance.

Display 600 further comprises display area 630 displaying a quantitative measure of shooting performance before and after feedback and/or training. Display area 630 can, for example, display an average score for the training results, alongside an average score for the benchmarks (such as the results prior to training), and accompanied by a numerical indication of the improvement achieved in training.

Display 600 also comprises menu 640 and exit button 650.

Figure 7:
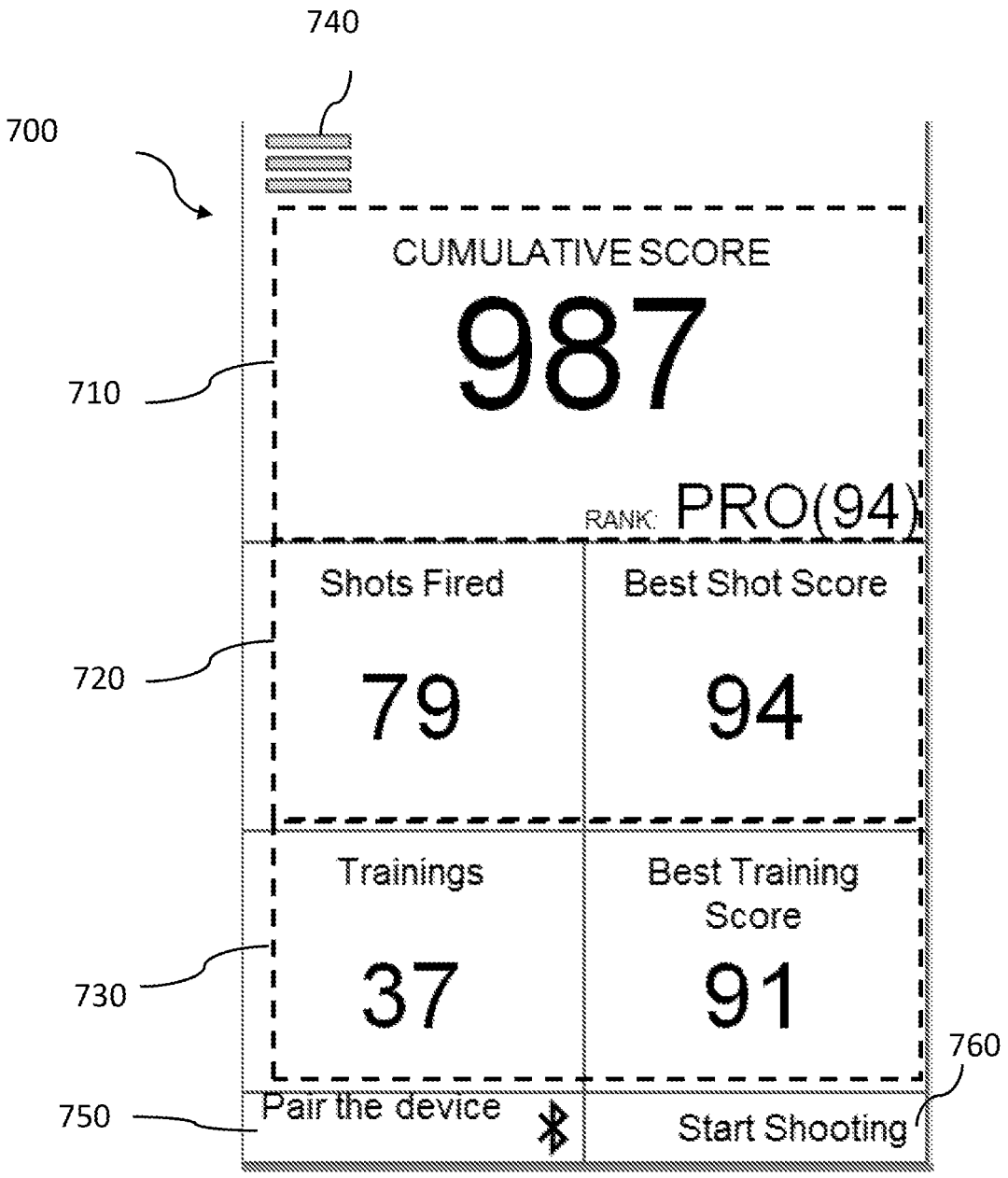

FIG. 7 is a screenshot of display 700 illustrating an embodiment of a user interface of a firearm training system (such as user interface 128 of firearm training system 100 of FIG. 1).

Display 700 is a summary display. Display 700 comprises display area 710 displaying a cumulative score and a ranking Display 700 further comprises display area 720 displaying a count of the number of shots fired and the score of the best shot overall. Display 700 comprises another display area 730 displaying a count of the number of trainings and the score of the best training shot.

Display 700 also comprises menu 740. Display 700 can comprise other elements such as buttons 750 and 760. The user can select button 750 to pair the device with another device via a wireless technology such as Bluetooth. The user can select button 760 to initiate the recording of a series of shots.

Figure 8:
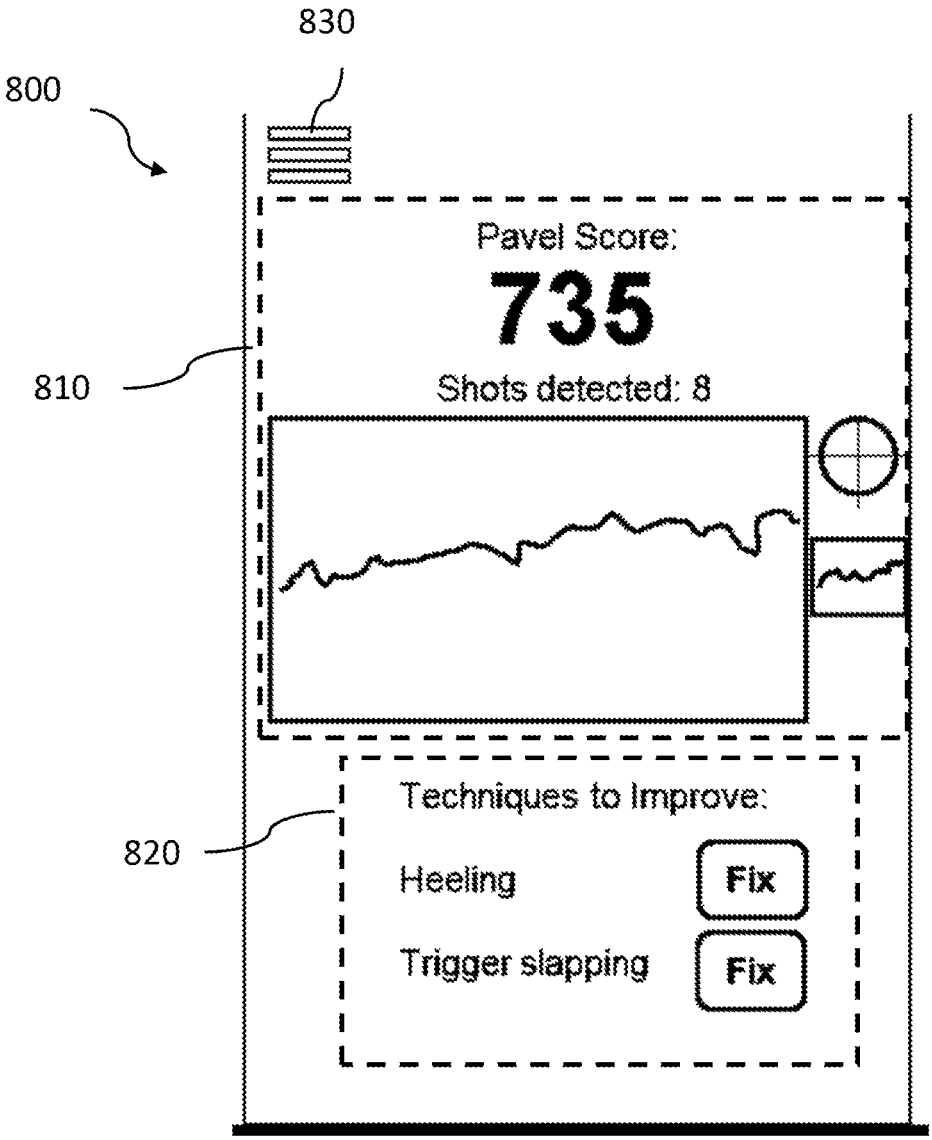

FIG. 8 is a screenshot of display 800 illustrating an embodiment of a user interface of a firearm training system (such as user interface 128 of firearm training system 100 of FIG. 1). Display 800 indicates one or more techniques to improve based on an analysis of a history of shots and shot scores.

Display 800 comprises display area 810 displaying a score and one or more visual indicators of shooting performance such as a shooting trend and a chart of deviation from the sighted position. Visual indicators can be selected by the user.

Display 800 further comprises a display area 820 displaying one or more techniques to improve (for example, heeling and trigger slapping), and providing the user with a button to select to begin a training sequence.

Display 800 also comprises menu 830.

Figure 9:
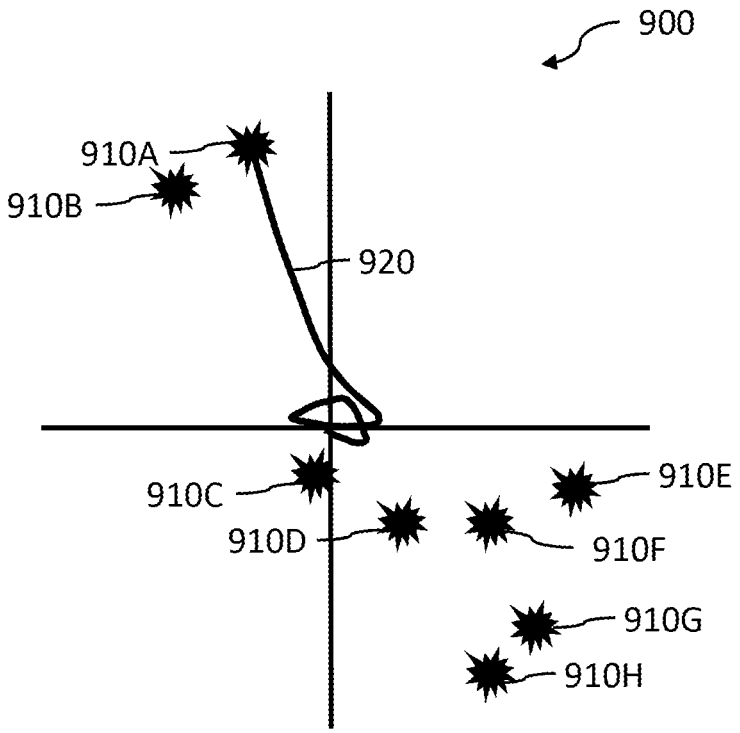

FIG. 9 is a screenshot of display 900 illustrating an embodiment of a user interface of a firearm training system (such as user interface 128 of firearm training system 100 of FIG. 1). Display 900 is a chart showing the position of one or more shots 910A through 910H relative to the sighted position. Display 900 also shows a trajectory 920 for shot 910A, the trajectory being the one taken by the shooter after sighting the target. Trajectory 920 results in a deviation of shot 910A from the sighted position, and can reflect deficiencies or errors in shooting technique.

Display 900 can provide direct feedback to the user about possible deficiencies and errors in shooting technique. Display 900 can also provide a visual indication of the data used by the firearm training system to propose to the user one or more techniques to improve.

Figure 12:
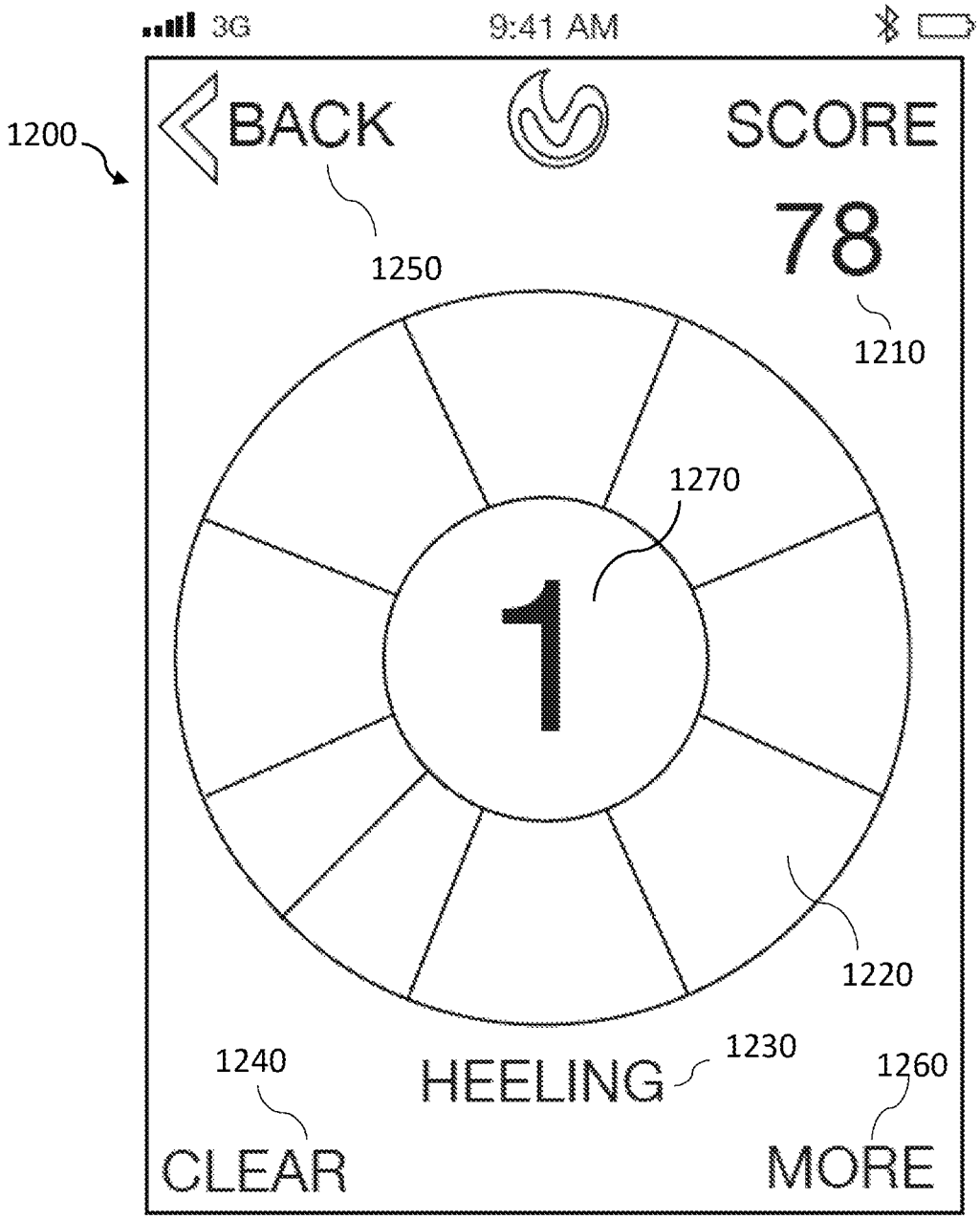
FIGS. 12, 13, 14, 15 and 16 are screenshots of displays illustrating an embodiment of a user interface of a firearm training system.

FIG. 12 is a screenshot of display screen 1200 that can appear on a computing device such as, but not limited to, a mobile phone or smartphone, a tablet computer, a notebook computer, a laptop computer, a desktop computer or other suitable electronic computing device. Display screen 1200 includes Score Display 1210 which can indicate the score for an individual shot and/or an average score when multiple shots have been fired.

Shots Fired Display 1270 shows the number of shots fired during a given training exercise. In some embodiments, Shots Fired Display 1270 can countdown the number of shots left to fire in a given exercise.

Feedback area 1230 can display feedback to the user. For example, feedback can comprise an indication of one or more deficiencies or errors in shooting technique, the indication, in some instances, accompanied by an illustration and/or a count of the number of times the deficiency or error has occurred. In some embodiments, the feedback is based on the last shot fired by the shooter.

Target Region 1220 displays the location of shots relevant to a sighted position.

Clear Button 1240 can be used to restart the data collection of the firearm training system and/or it can be used to clear the displayed data of a given shot while still retaining the collected data.

Back Button 1250 can be used to return to a previous screen and/or a predetermined screen such as a home screen.

More Button 1260 can be used to take a user to another screen, such a as a settings display. In some embodiments, More Button 1260 can bring up a drop-down menu that can contain a range of options including, but not limited to, navigation options, save options, preferences and settings. In some embodiments, More Button 1260 can bring up tutorials. In some embodiments, specific tutorials can be recommended based on the data collected by the firearm training system.

Figure 13:
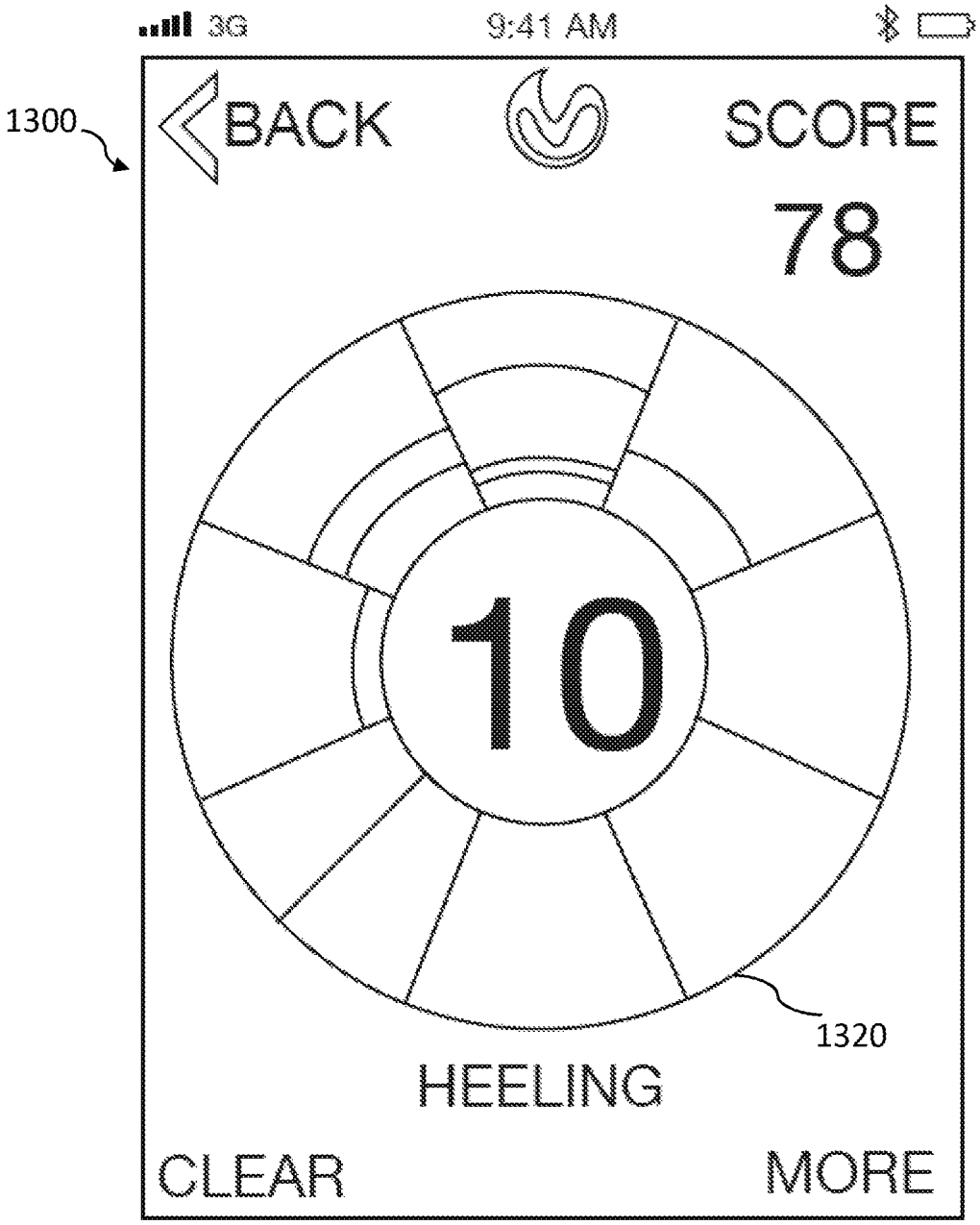

FIG. 13 is a screenshot of display screen 1300 similar to that shown in FIG. 12. In FIG. 13, Target Region 1320 displays the location of shots relevant to a given target in the form of a heat map.

Figure 14:
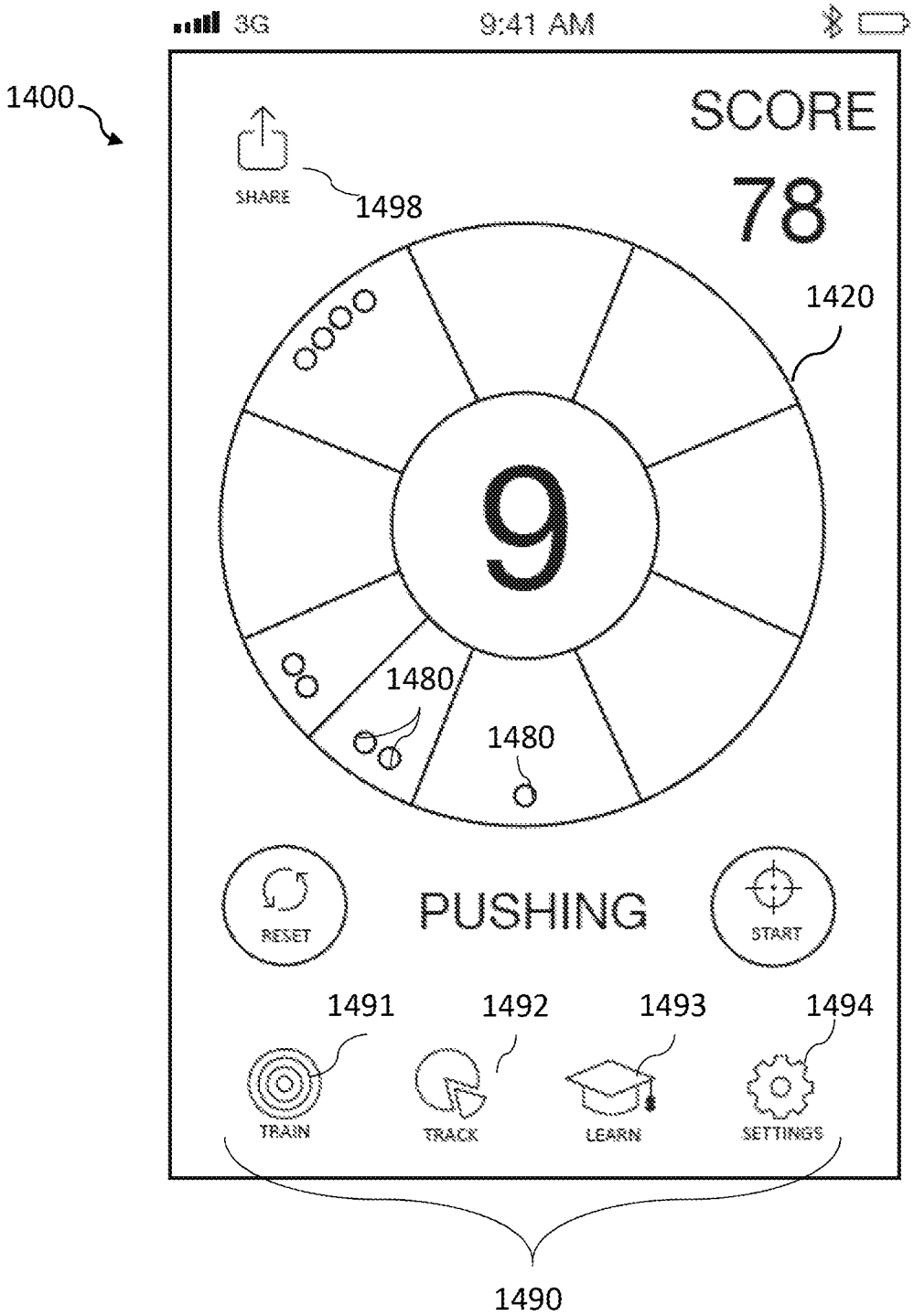

FIG. 14 is a screenshot of display screen 1400 similar to those shown in FIG. 12 and FIG. 13. In FIG. 14, Target Region 1420 displays the location of shots 1480 relative to a sighted position in Target Region 1420. Display screen 1400 also includes Menu Bar 1490. In some embodiments, Menu Bar 1490 is brought up by activating More Button 1260. Menu Bar 1490 can include, among other things, Train Button 1491, Tracking Button 1492, Tutorial Button 1493 and Settings Button 1494.

In some embodiments, display screen 1400 can also include Share Button 1498 which can be used to share results. Sharing results can include, but is not limited to, utilizing various social media sites, email and/or texting.

Figure 15:
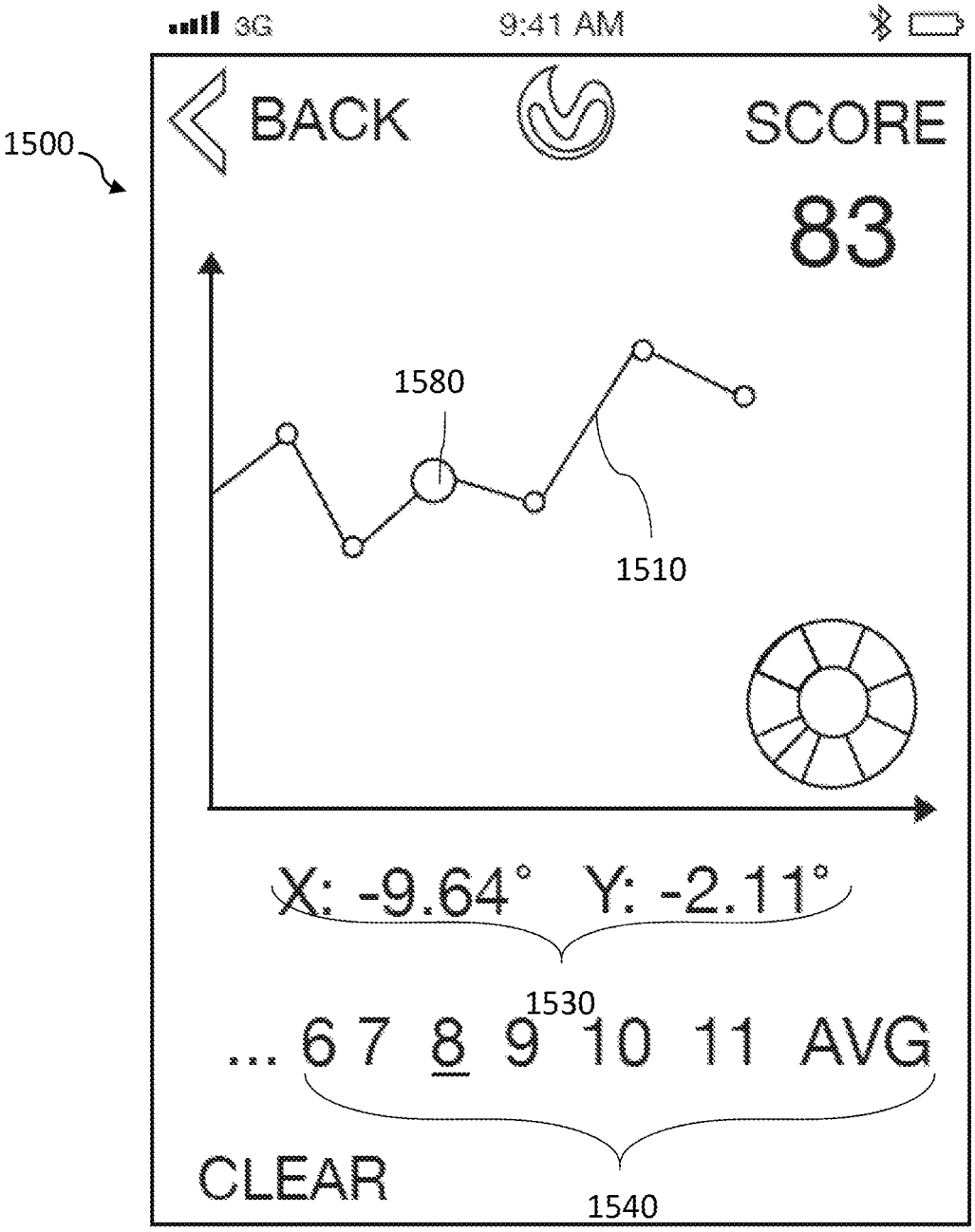

FIG. 15 is a screenshot of graph 1500 illustrating a shooting trend display for a series of consecutive shots showing deviation in distance from the sighted position. In graph 1500, shot 1580 has been highlighted and its position from the sighted position is indicated in Deviation Display 1530. Line 1510 shows the shot-by-shot deviation from the sighted position. Individual shots (or an average) can be selected from Shot Menu 1540 to determine the deviation of any given shot and/or the average deviation of a group of shots from the sighted position. In some embodiments, the number of shots used to determine the rolling average can be configured by the user.

Figure 16:
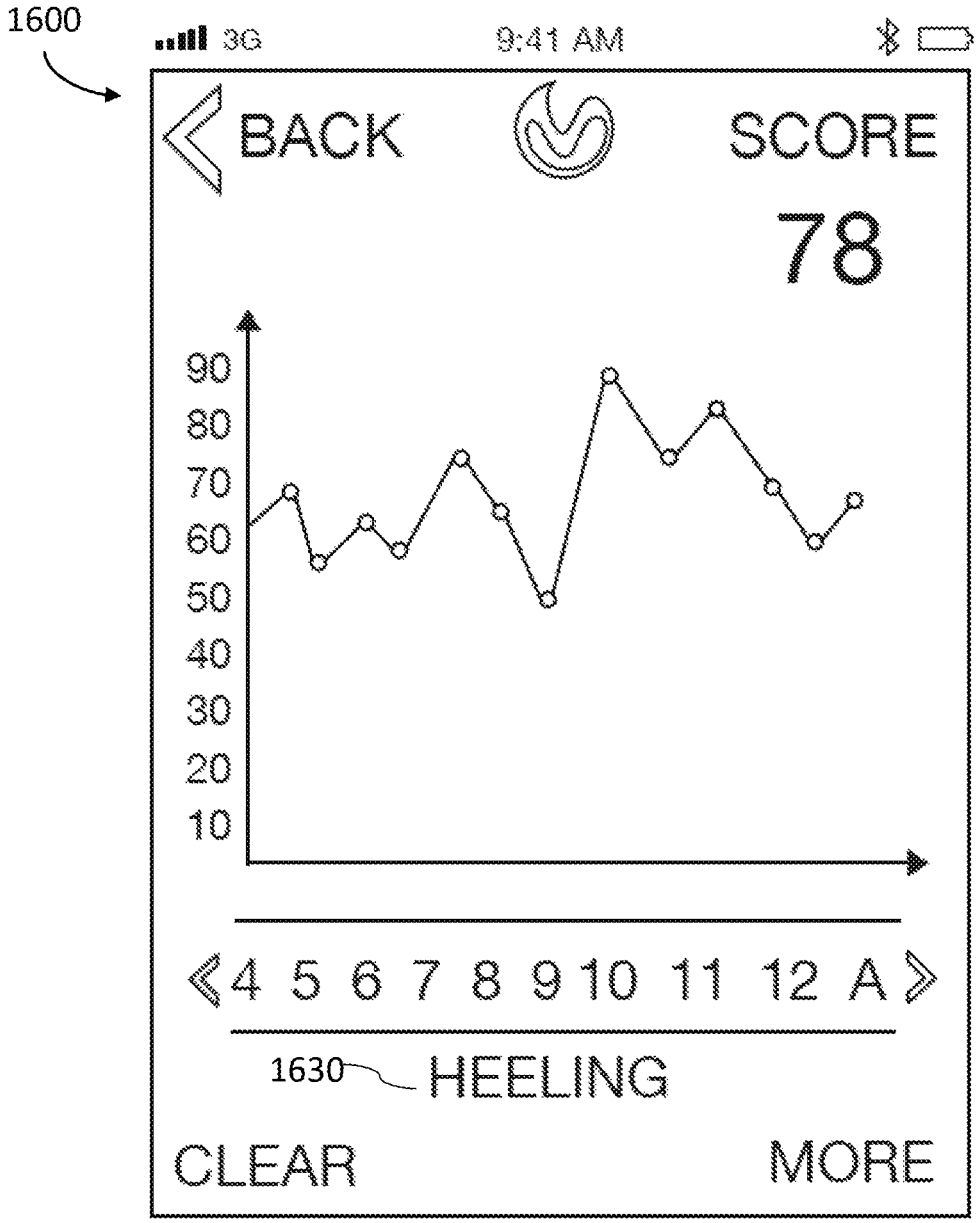

FIG. 16 is a screenshot of graph 1600 similar to that shown in FIG. 15. Graph 1600 includes feedback area 1630 which can display feedback to the user. For example, feedback can comprise an indication of one or more deficiencies or errors in shooting technique, the indication, in some instances, accompanied by an illustration and/or a count of the number of times the deficiency or error has occurred. In some embodiments, feedback is given for each shot. In other embodiments, feedback is given based on all or at least some of the shots fired.

Figure 10:
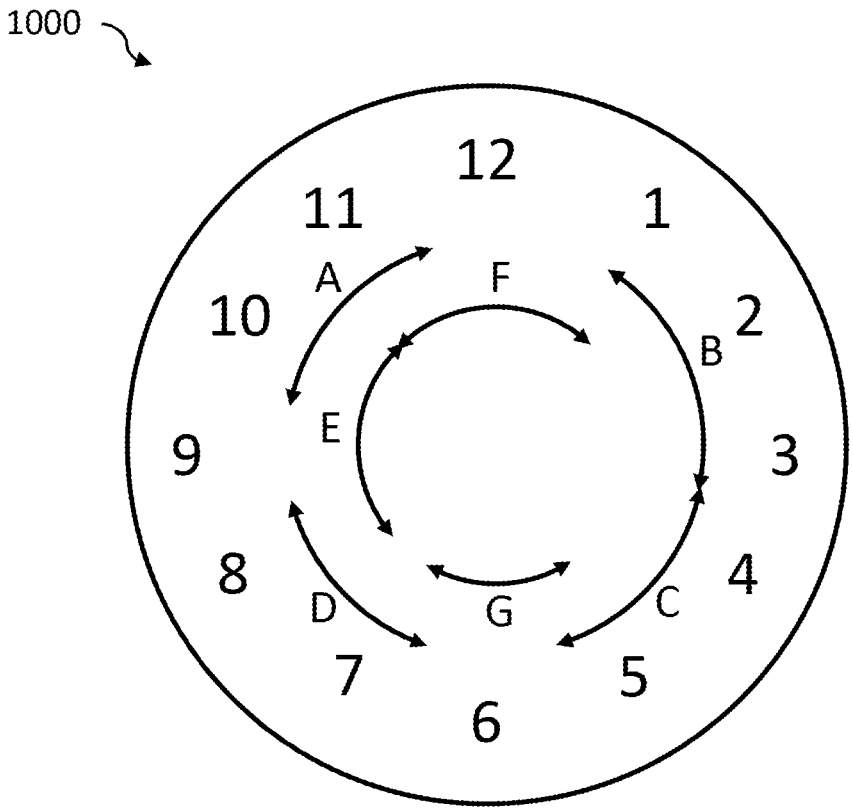
FIG. 10 is a diagram illustrating a rifle right-handed shooting diagnosis chart.

FIG. 10 is a diagram illustrating a rifle right-handed shooting diagnosis chart 1000. Chart 1000 can be used in conjunction with the firearm training system described herein. Elements related to chart 1000 can be integrated into the data recording, shot and technique analysis, and feedback and training aspects of the firearm training system. A similar chart is applicable for left-handed shooting analysis by using the mirror-image of Chart 1000.

Numerals 1 through 12 in FIG. 10 refer to angular positions relative to the sighted position at the center of the circle, by analogy with a clock face. Letters A through G are references to diagnoses A through G listed in Table 1 below.

TABLE 1

| | |
|---|---|
| A | Resting the fore-end towards the top of the palm or canting the rifle to the right and/or recoil anticipation. |
| B | Pressing the rifle over to the right to hold the sights on, canting the rifle to the left, insufficient grip with left hand, and/or jerking or pulling the trigger. |
| C | Trigger-pulling error, which can include pulling back steadily with the hand, trigger jerking and/or too tight of a grip. |
| D | Forcing the shoulder on to the butt and/or over anticipation of recoil. |
| E | Pressing the rifle over to the left (possibly to hold the sights on) and/or incorrect trigger pulling (pressure on right side of trigger). |
| F | Lifting the fore-end into the aiming-mark, and/or incorrect butt placement (too low in shoulder). |
| G | Forcing the sights down and/or trigger is pulled improperly (finger placed too low on the trigger). |

Figure 11:
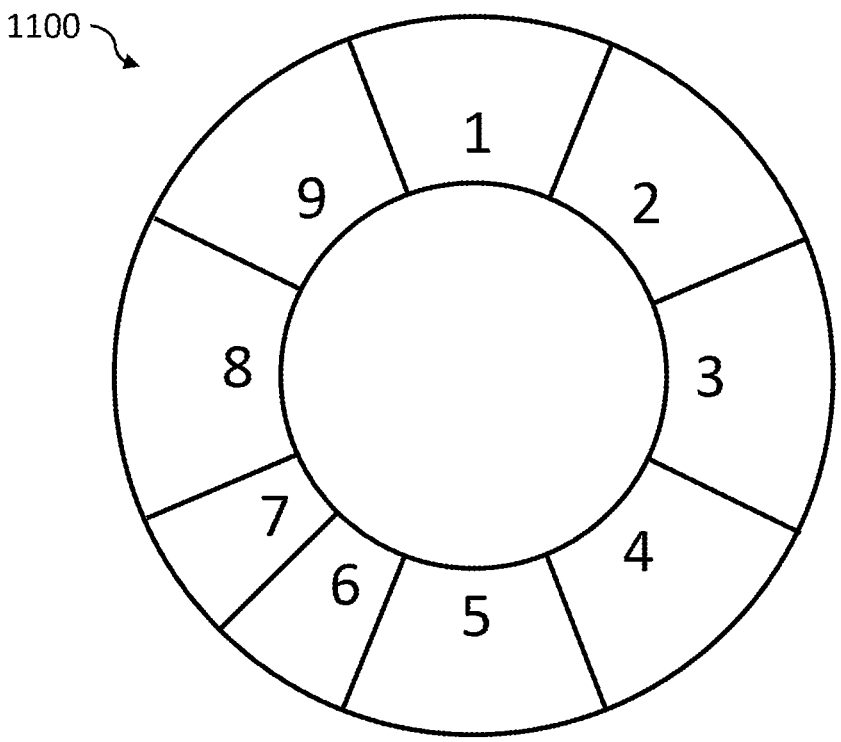
FIG. 11 is a diagram illustrating a handgun right-handed shooting diagnosis chart.

FIG. 11 is a diagram illustrating a handgun right-handed shooting diagnosis chart 1100. Chart 1100 can be used in conjunction with the firearm training system described herein. Elements related to chart 1100 can be integrated into the data recording, shot and technique analysis, and feedback and training aspects of the firearm training system. A similar chart is applicable for left-handed shooting analysis by using the mirror-image of Chart 1100.

Sectors in chart 1100 are labeled by numerals 1 through 9. Numerals 1 through 9 refer to deficiencies and errors in shooting technique, and the diagnoses for each one are listed in Table 2 below.

TABLE 2

| | |
|---|---|
| 1 | Breaking wrist up. |
| 2 | Heeling (anticipating recoil). |
| 3 | Thumbing (squeezing thumb) or too much trigger finger. |
| 4 | Tightening grip while pulling trigger. |
| 5 | Breaking wrist down, pushing forward or drooping head. |
| 6 | Jerking or slapping trigger. |
| 7 | Tightening fingers. |
| 8 | Too little trigger finger. |
| 9 | Pushing (anticipating recoil) or no follow through. |

A firearm training system (such as firearm training system 100 of FIG. 1) can detect and record a count of occurrences of one or more deficiencies and errors in shooting technique. Table 3 shows an example result.

TABLE 3

| | Sector No. | | | | | | | | |
|---|---|---|---|---|---|---|---|---|---|
| | 1 | 2 | 3 | 4 | 5 | 6 | 7 | 8 | 9 |
| Occurrences | 7 | 8 | 7 | 8 | 15 | 10 | 10 | 23 | 12 |

A count and analysis of detected deficiencies and errors in shooting technique can be used to provide feedback to a user via a user interface (such as user interface 128 of FIG. 1). Feedback can be provided in a number of ways including, but limited to, a score, a chart, a suggestion for techniques to improve, historical trends, and/or a comparison of training results versus various benchmarks.

In addition to the examples illustrated above, the user interface of the firearm training system described herein can comprise visualizations of the movement patterns and trajectories in two and three dimensions, as well as over time.

The user interface can be in the form of a mobile application, a desktop application, a speaker/audible system, a lighted system, renderings in two and three dimensions, and a suitable combination or component thereof.

The firearm training system described herein is not limited to the diagnoses illustrated in FIGS. 10 and 11. Other factors, and combinations of factors, can be used to diagnose deficiencies and errors in shooting technique, and to provide feedback to the user and suitable training sequences.

The apparatus and methods described above can be applied in a wide variety of products and application areas including, but not limited to the following:

Firearms and related accessories

Firearms instruction and training

Military training and exercises

Law enforcement and security personnel

While particular elements, embodiments and applications of the present invention have been shown and described, it will be understood, that the invention is not limited thereto since modifications can be made by those skilled in the art without departing from the scope of the present disclosure, particularly in light of the foregoing teachings.

What is claimed is:

1. A firearm training system comprising:

a) a firearm;

b) a sensor subsystem, wherein said sensor subsystem comprises:

i) a gyroscope;

ii) a magnetometer; and iii) an accelerometer, wherein said gyroscope, said magnetometer, and said accelerometer are used for measuring and recording a motion of said firearm during a period, wherein said period begins a given amount of time before user pulls a trigger of said firearm and ends essentially after said trigger is pulled;

c) a data processor configured to analyze a plurality of data points provided by said magnetometer, said accelerometer, and said gyroscope; and d) a display, wherein said display shows on a user interface a stability score, a trigger pull score, a recoil anticipation score, and a grip score based on said plurality of data points, wherein said data processor communicates with said sensor subsystem via a Bluetooth wireless signal.

2. The firearm training system of claim 1 further comprising:

c) a laser; and d) an inertial measurement unit.

3. The firearm training system of claim 1 wherein said data processor determines a trend.

4. The firearm training system of claim 3 wherein said display shows said trend.

5. The firearm training system of claim 3 wherein said trend indicates a shooting deficiency.

6. The firearm training system of claim 5 wherein said shooting deficiency is heeling.

7. The firearm training system of claim 5 wherein said shooting deficiency is thumbing.

8. The firearm training system of claim 7 wherein said firearm is a traditional firearm.

9. The firearm training system of claim 7 wherein said firearm is a simulated firearm.

10. The firearm training system of claim 5 wherein said firearm training system makes a suggested improvement based on said shooting deficiency.

11. The firearm training system of claim 1 wherein said data processor and said display are a single computing device.

12. The firearm training system of claim 11 wherein said computing device is a tablet.

13. The firearm training system of claim 11 wherein said computing device is a smartphone.

14. The firearm training system of claim 1 wherein said firearm is a pistol.

15. The firearm training system of claim 1 wherein said sensor subsystem is attached on a rail of said firearm.

16. The firearm training system of claim 1 wherein said sensor subsystem is attached on a magazine of said firearm.

17. The firearm training system of claim 1 wherein display shows a score display which shows an individual shot score and an average shot score.

18. The firearm training system of claim 17 wherein said individual shot score is calculated based on the deviation of an individual shot from a sighted position.

19. The firearm training system of claim 1 further comprising:

f) a website configured to store said plurality of data points.

* * * * *